US005431596A

United States Patent [19]

Akita et al.

[11] Patent Number: 5,431,596

[45] Date of Patent: Jul. 11, 1995

[54] GRINDING WHEEL AND A METHOD FOR MANUFACTURING THE SAME

[76] Inventors: Hiroshi Akita, 549, Oazanishi, Kamioka-cho, Yoshiki-gun, Gifu, Japan, 506-11; Kazuo Akita, 475-3, Hikishoharadera-machi, Sakai-shi, Osaka, Japan, 591

[21] Appl. No.: 234,362

[22] Filed: Apr. 28, 1994

[30] Foreign Application Priority Data

Apr. 28, 1993 [JP] Japan ..... 5-102529
Dec. 16, 1993 [JP] Japan ..... 5-317028

[51] Int. Cl.[6] ..... B24D 5/00
[52] U.S. Cl. ..... 451/540; 451/548
[58] Field of Search ..... 451/540, 541, 544, 546, 451/547, 548, 550, 551

[56] References Cited

U.S. PATENT DOCUMENTS

| | | | |
|---|---|---|---|
| 2,820,746 | 1/1958 | Keleric | 451/548 |
| 3,136,100 | 6/1964 | Robertson, Jr. | 451/548 |
| 3,477,180 | 11/1969 | Robertson, Jr. | 451/548 |
| 3,540,163 | 11/1970 | Shoemaker | 451/548 |
| 3,641,718 | 2/1972 | Ferchland | 451/548 |
| 3,867,795 | 2/1975 | Howard | 451/548 |
| 4,037,367 | 7/1977 | Kruse | 451/551 |
| 5,007,207 | 4/1991 | Phaal | 451/548 |
| 5,115,796 | 5/1992 | Schweickhardt | 451/548 |

FOREIGN PATENT DOCUMENTS

| | | |
|---|---|---|
| 50-35270 | 11/1975 | Japan . |
| 2-250775 | 10/1990 | Japan . |

*Primary Examiner*—Maurina T. Rachuba
*Attorney, Agent, or Firm*—Wenderoth, Lind & Ponack

[57] ABSTRACT

The present invention provides a grinding wheel including an inner offset section and an outer flange section, capable of effectively utilizing abrasive grains without causing partial abrasion, and a method for manufacturing such a grinding wheel. The grinding wheel includes: a vibration preventing base having a supporting body and a reinforcement disposed thereon, the supporting body being formed of a supporting material made by mixing fine abrasive grains and binder, the reinforcement being provided with grooves formed in a grid-like manner to have square waves; an abrasive body formed of an abrasive made by mixing rough abrasive grains and binder; and a mandrel to be received by bores formed at central portions of the vibration preventing base and the abrasive body.

20 Claims, 13 Drawing Sheets

GRINDING WHEEL AND A METHOD FOR MANUFACTURING THE SAME

BACKGROUND OF THE INVENTION

1. Field of the Invention

The present invention relates to a grinding wheel and a method for manufacturing the same, especially to a grinding wheel effectively utilizing abrasive grains without causing partial abrasion and a method for manufacturing the same.

2. Description of the Prior Art

Hitherto, there has been proposed a grinding wheel to be mounted on a grinder, etc. for grinding a metal or non-metal material such as described in TOKKYO KOHO No. 50-35270. Such a grinding wheel, which includes an outer flange section and an inner offset section protruding to have a trapezoid shape, is formed of an abrasive which is made by bonding rough abrasive grains with one another using phenol resin type binder. Moreover, a reinforcement, which is made by immersing denatured phenol resin or denatured epoxy resin in plain-woven fabric made of glass fiber, is buried in the grinding wheel. In addition, in order to impart flexibility to the grinding wheel, grooves are formed in a grid-like manner on the grinding surface of the grinding wheel so as to be cracked at the bottom.

However, such a grinding wheel is gradually worn from the periphery to reduce the diameter. As a result, the circumferential speed of the grinding wheel is lowered; that is, the hardness of the grinding wheel against an object to be ground is lowered.

Consequently, the abrasive grains are rapidly peeled off. Therefore, when the grinding wheel is worn to some degree, it is required to be exchanged with new one.

Since such a conventional grinding wheel is formed of rough abrasive grains evenly, there arises a problem that all of the rough abrasive grains are not utilized effectively. That is, the grinding wheel is conventionally exchanged with new one even though some of the rough abrasive grains remain unworn at an inner portion thereof. For example, a case of a grinding wheel having an outer diameter of 100 mm, a thickness of 3 mm, and a hole diameter of 15 mm will be described. When assuming that such a grinding wheel is exchanged with new one after 30% of the total abrasive grains are worn, only about 50% of the total abrasive grains are actually used for the grinding process, and the remaining abrasive grains are uselessly discarded.

In addition, the grooves are formed in the grid-like manner on the grinding surface of the grinding wheel so as to be cracked at the bottom, thereby imparting flexibility to the grinding wheel.

However, the grooves are likely to be cracked unevenly. Moreover, the density of the fabric used as the reinforcement cannot be uniform in the circumferential direction, so that the elasticity of the grinding wheel cannot be uniform either in the circumferential direction. As a result, the grinding wheel cannot readily be flexed in a weft direction nor a warp direction, but it is relatively readily flexed in other directions, especially in a diagonal direction connecting junctions of the weft and warp. Due to such a difference in elasticity, vibration called "tapping" occurs during the grinding process. That is, the portion of the grinding wheel readily being flexed is negatively contact with the object to be ground, so that it is worn slowly. On the other hand, the portion not being readily flexed is positively contact with the object, so that it is worn rapidly. Thus, the conventional grinding wheel has a problem of partial abrasion.

To overcome the problem in that the grinding wheel is inevitably flexed unevenly, there has been proposed a grinding wheel in which an abrasive layer is formed so that the thickness thereof is made thinner in a direction from the outer flange section to the inner offset section, while a backing layer is formed so that the thickness thereof is made thicker in the same direction, such as described in KOKAI TOKKYO KOHO No. 2-250775. However, in a case where a reinforcement is included in the above grinding wheel, "tapping" still occurs due to a difference in elasticity of the grinding wheel in the circumferential direction. That is, even the above grinding wheel cannot solve the problem of partial abrasion.

SUMMARY OF THE INVENTION

To overcome the above problems peculiar to the conventional grinding wheel, it is an object of the present invention to provide a grinding wheel capable of effectively utilizing abrasive grains.

Another object of the present invention is to provide a grinding wheel without causing partial abrasion by preventing the occurrence of vibration during the grinding process so that the grinding surface can evenly be brought in contact with an object to be ground.

A further object of the present invention is to provide a grinding wheel having durability by removing chippings to clog grinding pieces during the grinding process.

A still further object of the present invention is to provide a grinding wheel capable of firmly supporting an abrasive body by preventing the occurrence of tensile stress at the interface between an inner offset section and an outer flange section due to excessive flexing of the abrasive body.

According to another aspect of the present invention, it is an object of the invention to provide a method for simply manufacturing a grinding wheel capable of effectively utilizing abrasive grains and removing chippings to clog grinding pieces without causing vibration nor partial abrasion.

Another object of the present invention is to provide a method for manufacturing a grinding wheel on an assembly line, the grinding wheel being capable of effectively utilizing abrasive grains without causing vibration nor partial abrasion.

A further object of the present invention is to provide a method for manufacturing a grinding wheel on an assembly line, the grinding wheel being capable of effectively utilizing abrasive grains and firmly supporting an abrasive body without causing vibration nor partial abrasion.

The above and further objects, features and advantages of the invention will more fully appear from the following description with reference to the accompanying drawings. It is to be expressly understood, however, that the drawings are for purpose of illustration only, and are not intended as a definition of the limits of the invention.

DETAILED DESCRIPTION OF THE PREFERRED EMBODIMENTS

Hereinafter, the present invention will be described by way of illustrating preferred examples with reference to drawings.

EXAMPLE 1

Figure 1:
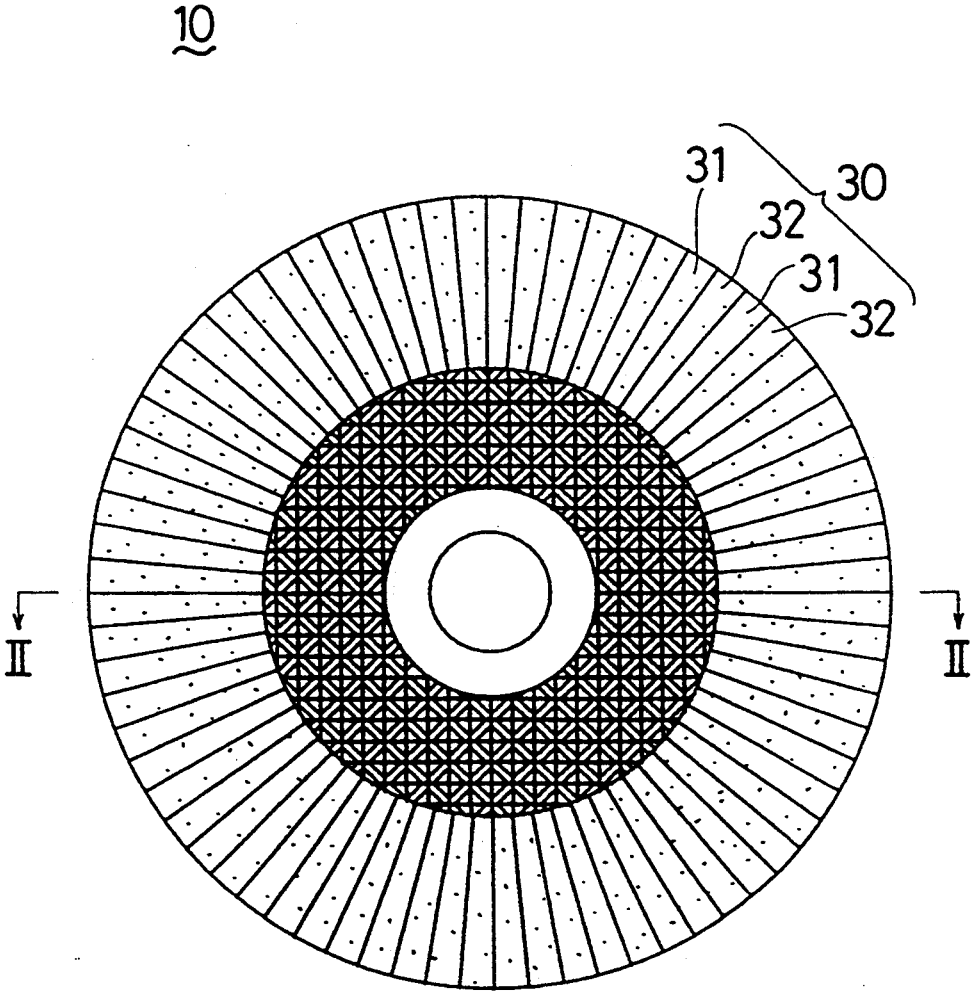
FIG. 1 is a bottom view of a grinding wheel according to Example 1 of the present invention.
Figure 2:
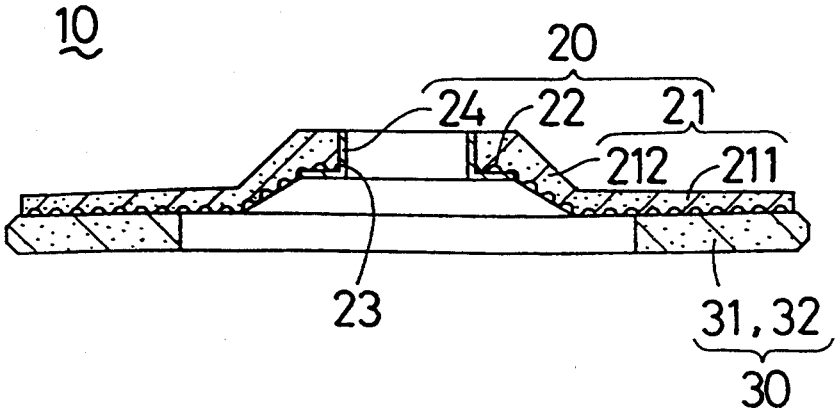
FIG. 2 is a cross-sectional view taken along a line II to II of FIG. 1.
Figure 3:
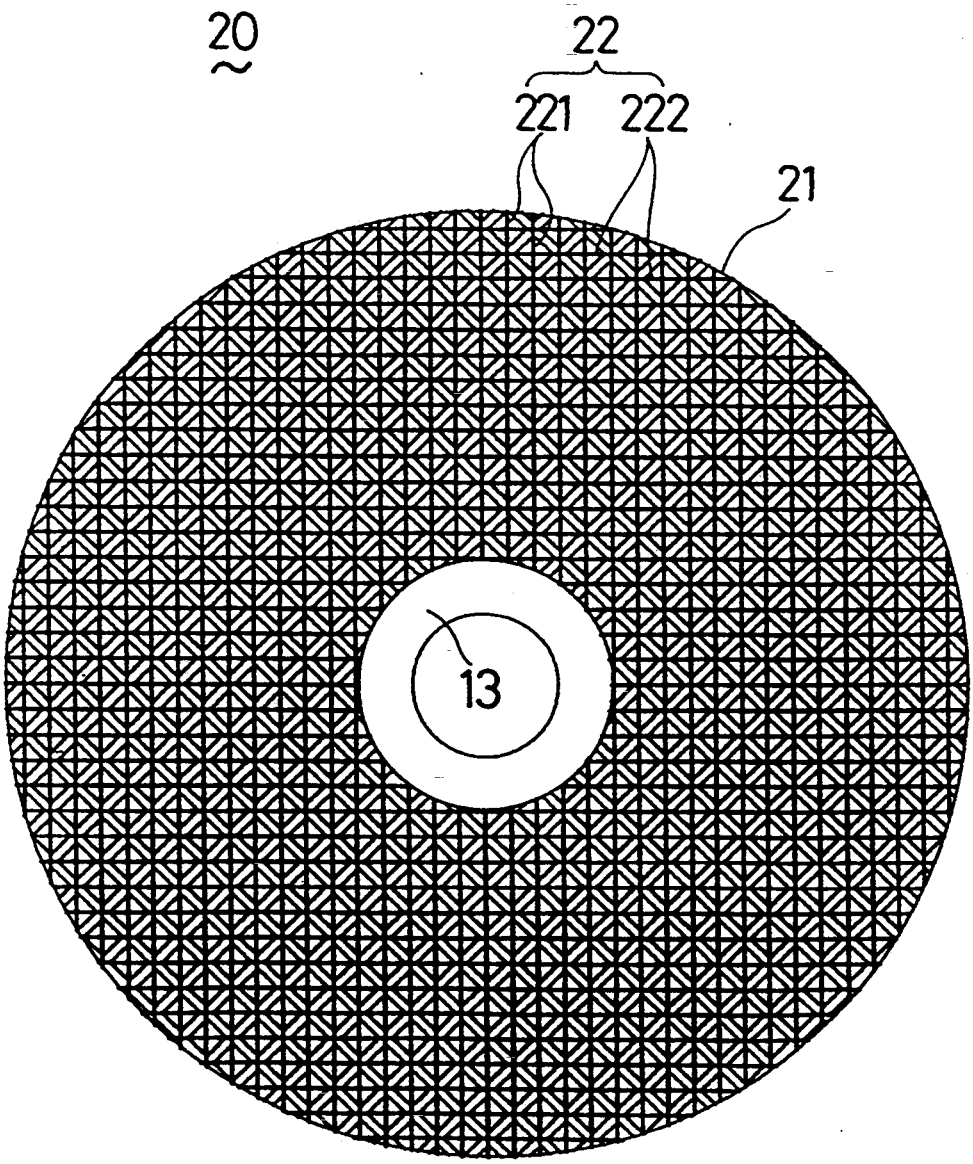
FIG. 3 is a bottom view of a vibration preventing base for the grinding wheel of FIG. 1.

FIGS. 1 and 2 show a grinding wheel 10 according to Example 1 of the present invention. The grinding wheel 10 comprises a vibration preventing base 20 and a circular abrasive body 30 disposed thereon.

The vibration preventing base 20, which includes an outer flange section 211 and an inner offset section 212 protruding to have a trapezoid shape, comprises: a supporting body 21 formed of a supporting material made by mixing fine abrasive grains and thermoset resin such as denatured phenol resin or denatured epoxy resin; a reinforcement 22 disposed on the surface of the supporting body 21 and provided with grooves 25 formed in a grid-like manner to have square waves; and a mandrel 24 to be received by a bore 23 formed at a central portion of the supporting body 21 so as to be attached to an output axis of a grinder or the like.

Figure 4:
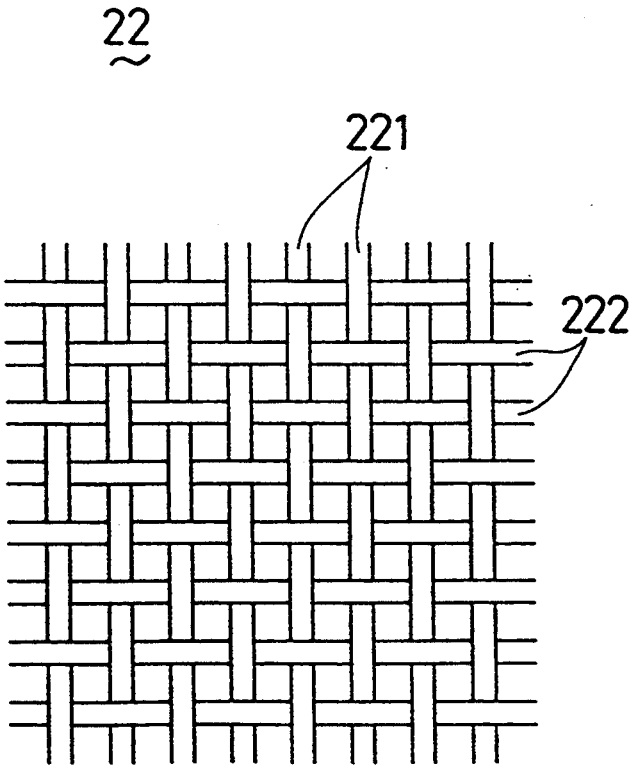
FIG. 4 is a view for illustrating fabric used as a reinforcement for the grinding wheel of FIG. 1.

As the reinforcement 22 for the vibration preventing base 20, plain-woven fabric or twill-woven fabric made of glass fiber, carbonized fiber, or aramid fiber such as shown in FIG. 4 may be employed. The fabric is provided with grooves 25 formed in diagonal directions connecting Junctions of warp 221 and weft 222 thereof. Hereinafter, a method for obtaining such a reinforcement 22 will be described. First, plain-woven fabric made of glass fiber or the like is immersed in thermoset resin such as denatured phenol resin or denatured epoxy resin, and then is passed through a furnace. Next, the fabric is cut so as to have a prescribed shape, and is heated. Thereafter, the fabric is pressed using an upper mold 41 including convex portions 411 and concavo portions 412 to form a grid-like concavo-convex pattern on a molding surface thereof. The thus immersed thermoset resin is softened so that junctions of the warp 221 and the weft 222, corresponding to the convex portions 411, may be sunk, and finally, the grooves 25 are formed in the grid-like manner to have square waves in diagonal directions connecting the junctions of the warp 221 and weft 222.

The above process is performed under a condition where the reinforcement 22 is disposed on the supporting body 21, so that grooves are also formed in the grid-like manner on the supporting body 21 in diagonal directions connecting the junctions of the warp 221 and weft 222 of the reinforcement 22.

At this time, a space between the respective convex portions 411 arranged in the same direction is made the same as a diagonal length between two adjacent junctions of the warp 221 and weft 222. In addition, the warp 221 and weft 222 should be arranged so as to be inclined at an angle of 45° relative to the grid like concavo-convex pattern of the upper mold 41.

On the other hand, the abrasive body 30 is constructed of grinding pieces 31 and chipping remover pieces 32 which are made by mixing abrasive grains of fused alumina, silicon carbide, diamond or the like with binder made of thermoset resin such as denatured phenol resin or denatured epoxy resin. The grinding pieces 31 and the chipping remover pieces 32 are alternately bonded on the peripheral portion of the reinforcement 22 for the vibration preventing base 20 so as to form a ring-like shape. In more detail, the grinding pieces 31 are made of an abrasive mixedly including abrasive grains and binder at a high density. On the other hand, the chipping remover pieces 32 are made of a porous material mixedly including rough abrasive grains and binder at a low density. After being alternately bonded, the pieces 31 and 32 are sintered, thereby obtaining the abrasive body 30 of the present example.

The grinding wheel 10 is thus constructed of the vibration preventing base 20 not to be used for grinding, and the abrasive body 30 to be used for grinding. Therefore, rough abrasive grains having grinding ability are used only for the abrasive body 30. On the other hand, even fine abrasive grains, which have not been utilized conventionally, can be used for the supporting body for the vibration preventing base 20, thereby effectively utilizing all of the abrasive grains. Especially, in a case of melted alumina type of abrasive grains, the yield of an ingot can be improved. Moreover, the grooves which are formed in the grid-like manner on the reinforcement 22, make the elasticity of the reinforcement almost uniform in all directions including a warp direction, a weft direction, and a diagonal direction connecting adjacent junctions of the warp 221 and weft 222 of the reinforcement 22. As a result, vibration, which conventionally occurs during the grinding process, can be prevented, so that every part of the abrasive body 30 can almost evenly be brought in contact with an object to be ground. Thus, the abrasive body 30 can be prevented from being partially worn. Furthermore, by bonding the chipping remover pieces 32 alternately with the grinding pieces 31, it is possible to remove chippings generated by the grinding pieces 31 during the grinding process, thereby preventing the grinding pieces 31 from clogging. Thus, the grinding wheel 10 of the present example has longer durability than a conventional grinding wheel has.

Figure 5:
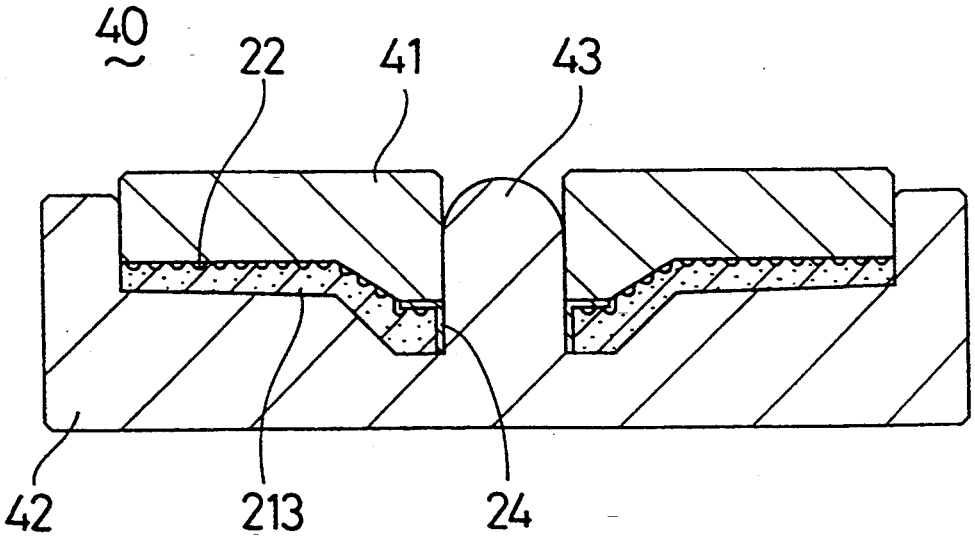
FIG. 5 is a cross-sectional view of a molding apparatus for molding the vibration preventing base of FIG. 3.

Next, a method for manufacturing the vibration preventing base 20 included in the grinding wheel 10 using a molding apparatus 40 such as shown in FIG. 5 will be described.

The molding apparatus 40 is constructed of a lower mold 42 capable of forming a cavity adapted to the vibration preventing base 20, and an upper mold 41. The lower mold 42 includes an upward protruding stem having a diameter adapted to the mandrel 24, and a surface corresponding to the back of the vibration preventing base 20. The upper mold 41 includes a molding surface having a concavo-convex pattern consisting of the convex portions 411 and concavo portions 412 for forming the grooves 25 on the surface of the vibration preventing base 20.

The vibration preventing base 20 of the present example can be molded using such a molding apparatus 40 as follows: First, a prescribed amount of a supporting material, which is made by mixing fine abrasive grains and thermoset resin such as denatured phenol resin, is placed in the lower mold 42, and is homogenized using a homogenizer (not shown), thereby forming a supporting layer 213 corresponding to the outer flange section 211 and the inner offset section 212. Then, the reinforcement 22 including thermoset resin such as denatured phenol resin is disposed on the supporting layer 213. Thereafter, the supporting layer 213 and the reinforcement 22 are heated, and then are pressed using the upper mold 41 so as to form the grooves 25 in the grid-like manner.

At this time, the warp 221 and the weft 222 of the fabric used as the reinforcement 22 are arranged so as to be inclined at an angle of 45° relative to the concavo-convex pattern of the upper mold 41.

After the grooves 25 are formed in the grid-like manner to have square waves, the supporting layer 213 and the reinforcement 22 are taken out from the molding apparatus 40 and are sintered using a furnace (not shown), thereby obtaining the vibration preventing base 20 of the present example.

Figure 7:
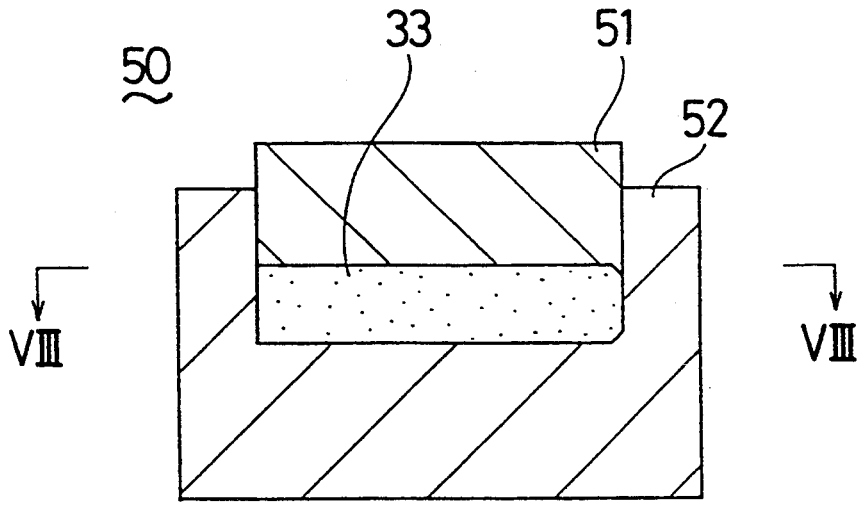
FIG. 7 is a cross-sectional view of a molding apparatus for molding grinding pieces and chipping removing wheel of FIG. 1.
Figure 8:
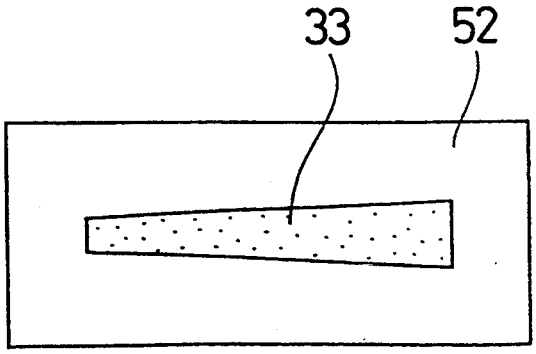
FIG. 8 is a cross-sectional view taken along a line of VIII to VIII of FIG. 7.

On the other hand, in order to mold the grinding pieces 31 for the abrasive body 30, a piece molding apparatus 50 such as shown in FIG. 7 may be employed. The piece molding apparatus 50 is constructed of a lower mold 52 capable of forming a cavity adapted to the shape of each grinding piece 31, and an upper mold 41. First, a prescribed amount of an abrasive, which is made by mixing abrasive grains and binder at a high density, is placed in the lower mold 52, and is homogenized using a homogenizer (not shown), thereby forming an abrasive layer 33. Then, the abrasive layer 33 is heated and then is pressed using the upper mold 51. Thereafter, the abrasive layer 33 is taken out from the piece molding apparatus 50 and then is sintered, thereby obtaining the grinding piece 31 of the present example. The chipping remover pieces 32 may be molded in the same manner as that for the grinding pieces 31 except that a porous material made by mixing rough abrasive grains and binder at a low density is used instead of the abrasive.

Finally, the thus obtained grinding pieces 31 and the chipping remover pieces 32 are alternately bonded on peripheral portion of the reinforcement 22 for the vibration preventing base 20. As is described above, the grinding wheel 10 of the present example can be manufactured with such a simple procedure.

EXAMPLE 2

Figure 9:
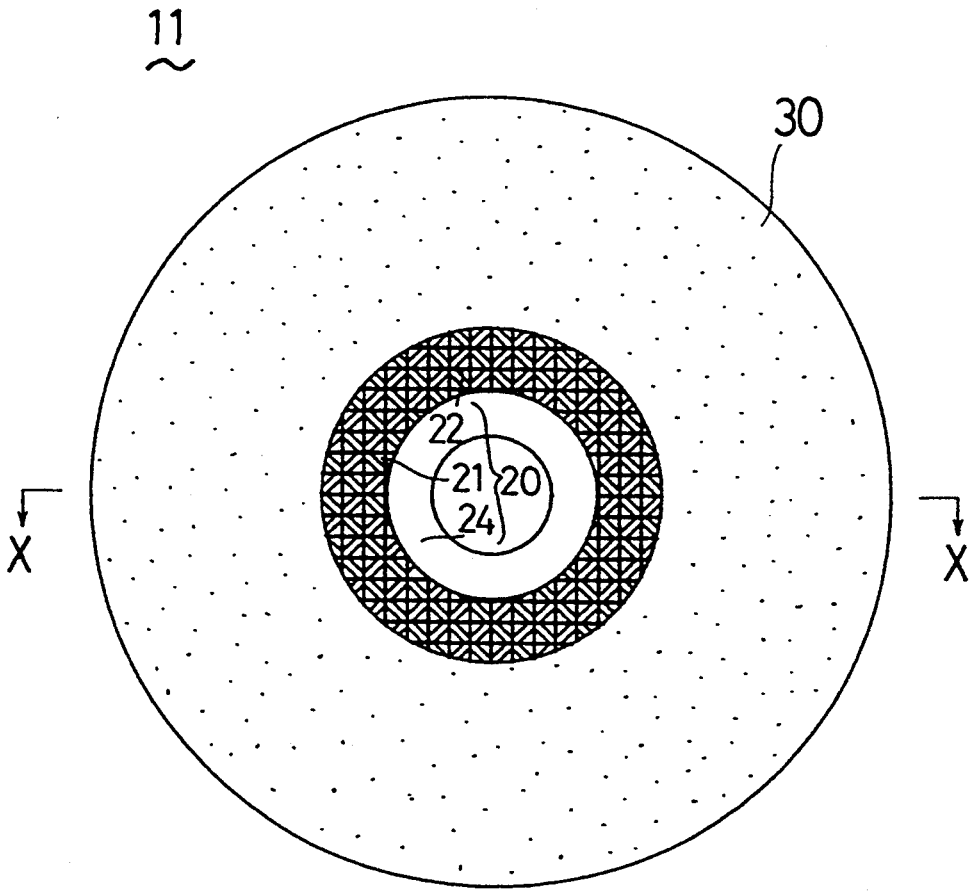
FIG. 9 is a bottom view of a grinding wheel according to Example 2 of the present invention.
Figure 10:
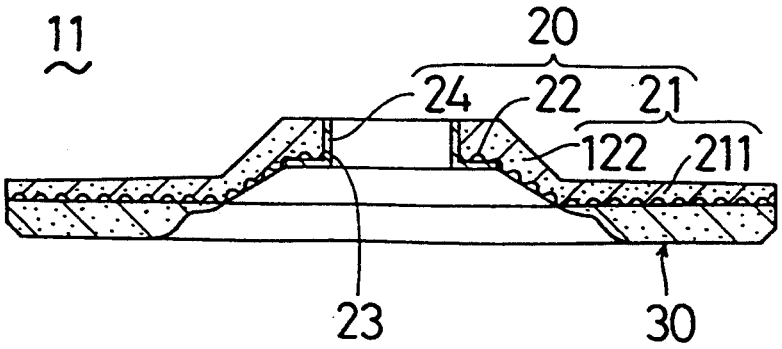
FIG. 10 is a cross-sectional view taken along a line of X to X of FIG. 9.

FIGS. 9 and 10 show a grinding wheel 11 according to Example 2 of the present invention, in which like components are denoted as like reference numerals used for Example 1.

Similarly to the grinding wheel 10 of Example 1, the grinding wheel 11 comprises a vibration preventing base 20, and a circular abrasive body 30 disposed thereon.

The vibration preventing base 20, which includes an outer flange section 211 and an inner offset section 212, comprises: a supporting body 21 formed of a supporting material made by mixing fine abrasive grains and thermoset resin; a reinforcement 22 arranged on the surface of the supporting body 21 and provided with grooves 25 formed in the grid-like manner to have square waves; and a mandrel 24 to be received by a bore 23 formed at a central portion of the supporting body 21. Thus, the vibration preventing base 20 of the present example has the same configuration as that of Example 1, and therefore the detailed description thereof will be omitted.

On the other hand, an abrasive body 30, which has a ring-like shape, is formed of an abrasive made by mixing predetermined amounts of rough abrasive grains of melted alumina or the like and binder made of thermoset resin.

Thus, the grinding wheel 11 of the present example, which is constructed of the vibration preventing base 20 not to be used for grinding, and an abrasive body 30 to be used for grinding, can achieve the same effects of Example 1. That is, rough abrasive grains having grinding ability are used only for the abrasive body 30. On the other hand, even fine abrasive grains, which have not been utilized conventionally, can be used for the supporting body 21 for the vibration preventing base 20, thereby effectively utilizing all of the abrasive grains. Moreover, the grooves 25, which are formed in the grid-like manner on the reinforcement 22, make the elasticity of the reinforcement 22 almost uniform in all directions including a warp direction, a weft direction, and a diagonal direction connecting the adjacent Junctions of the warp and weft of the reinforcement 22. As a result, vibration, which conventionally occurs during the grinding process, can be prevented, so that every part of the abrasive body 30 can almost evenly brought in contact with an object to be ground. Thus, the abrasive body 30 can be prevented from being partially worn. Therefore, the grinding wheel 11 of the present example can have longer durability compared with a conventional one.

Figure 11:
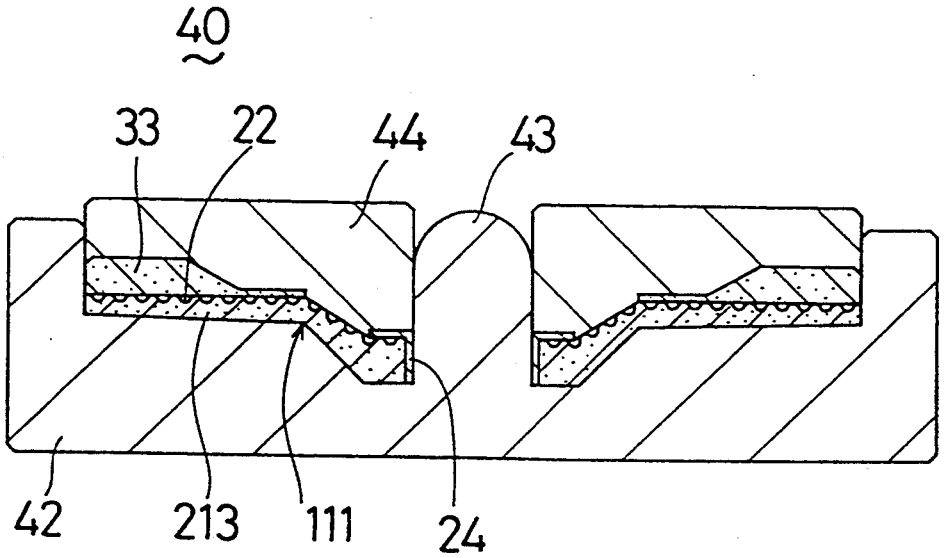
FIG. 11 is a cross-sectional view of a molding apparatus for molding the grinding wheel of FIG. 9.

Next, a method for manufacturing the vibration preventing base 20 included in the grinding wheel 11 using a molding apparatus 40 such as shown in FIG. 11 will be described. First, a prescribed amount of a supporting material, which is made by mixing fine abrasive grains and thermoset resin such as denatured phenol resin, is placed in a lower mold 42, and is homogenized using a homogenizer (not shown), thereby forming a supporting layer 213 corresponding to the outer flange section 211 and the inner offset section 212. Then, the reinforcement 22 including thermoset resin such as denatured phenol resin is disposed on the supporting layer 213. Thereafter, the supporting layer 213 and the reinforcement 22 are heated, and then are pressed using an upper mold 41 so as to form grooves 25 in the grid-like manner. At this time, the warp 221 and the weft 222 of the fabric functioning as the reinforcement 22 are arranged so as to be inclined at an angle of 45° relative to the concavo-convex pattern of the upper mold 41.

Thereafter, the upper mold 41 is taken out from the apparatus 40. Then, a predetermined amount of an abrasive made by mixing rough abrasive grains and binder such as denatured phenol resin is placed on the peripheral portion of the vibration preventing base 20 provided with the grooves 25, and is homogenized using a homogenizer (not shown), thereby forming an abrasive layer 33. Next, this abrasive layer 33 is heated, and is pressed using a pressing mold 44 having a surface corresponding to the grinding surface of the grinding wheel 11, thereby obtaining a semi-manufactured item 111 (see FIG. 11). Thereafter, the semi-manufactured item 111 is taken out from the apparatus 40, and is sintered using a furnace, thereby obtaining the grinding wheel 11. As is apparent from the above, the grinding wheel 11 of the present example can simply be manufactured on an assembly line.

EXAMPLE 3

Figure 12:
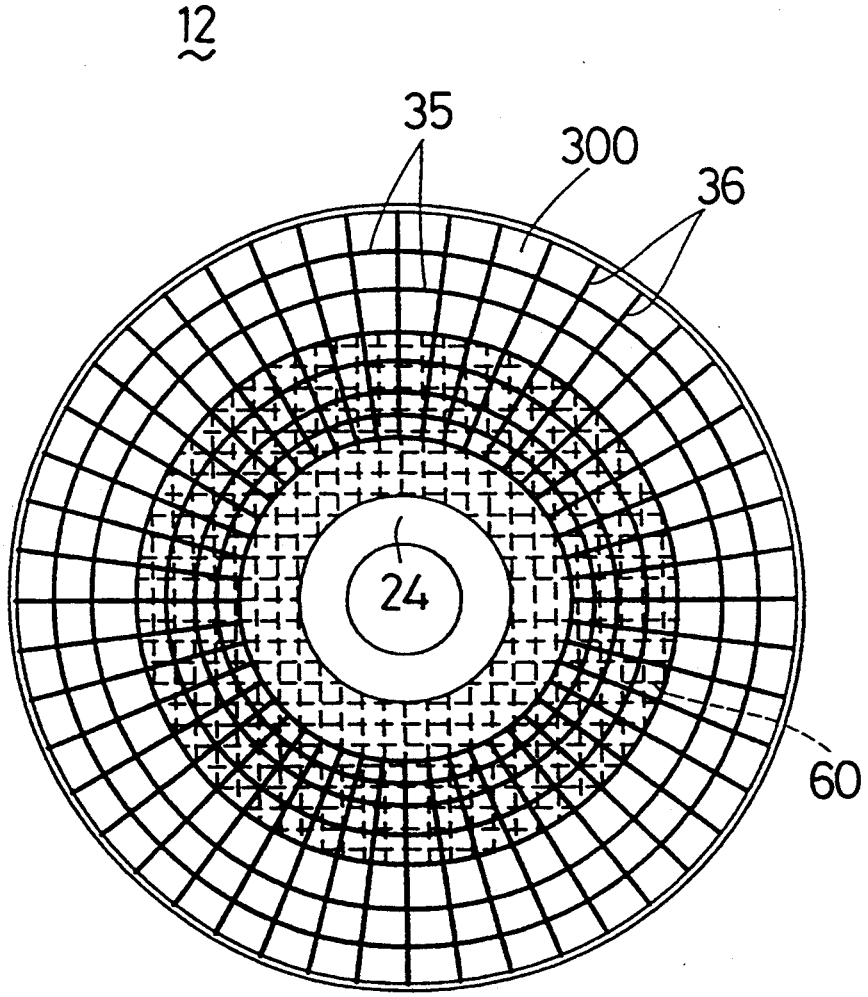
FIG. 12 is a bottom view of a grinding wheel according to Example 3 of the present invention.
Figure 13:
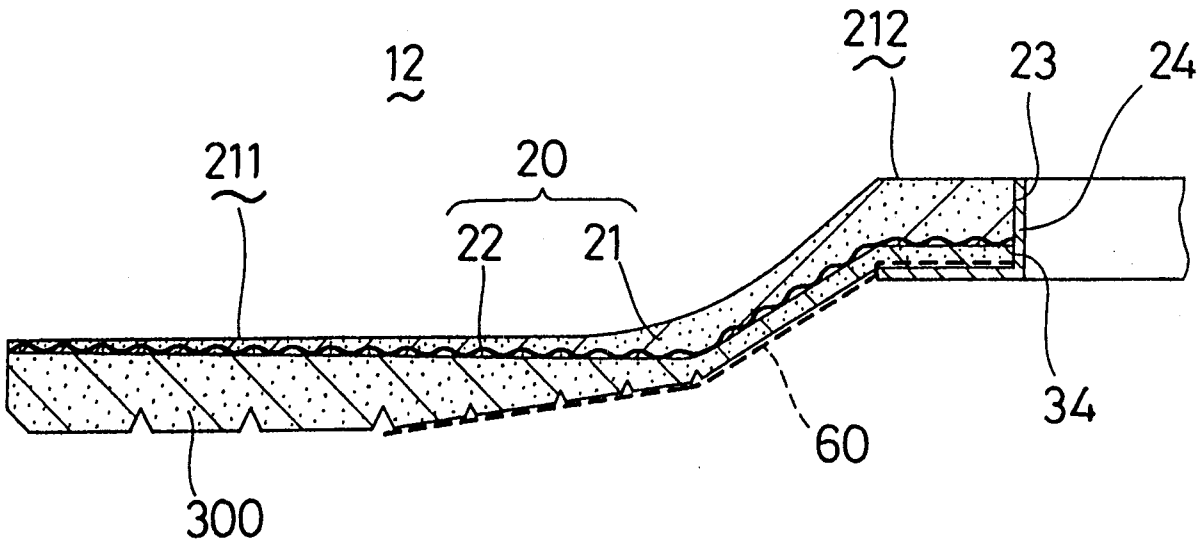
FIG. 13 is a half cross-sectional view of the grinding wheel of FIG. 12.

FIGS. 12 and 13 show a grinding wheel 12 according to Example 3 of the present invention, in which like components are denoted as like reference numerals used for Examples 1 and 2.

The grinding wheel 12, which includes an inner offset section 212 protruding to have a trapezoid shape, and an outer flange section 211, comprises: a vibration preventing base 20; a circular abrasive body 300 disposed on the surface of the vibration preventing base 20; an abrasive body reinforcing member 60 arranged so as to cover an inner portion of the abrasive body 300; and a mandrel 24 to be received by bores 23 and 34 formed at the central portions of the vibration preventing base 20 and the abrasive body 300 so as to hold the inner peripheral edge of the abrasive body reinforcing member 60.

Figure 14:
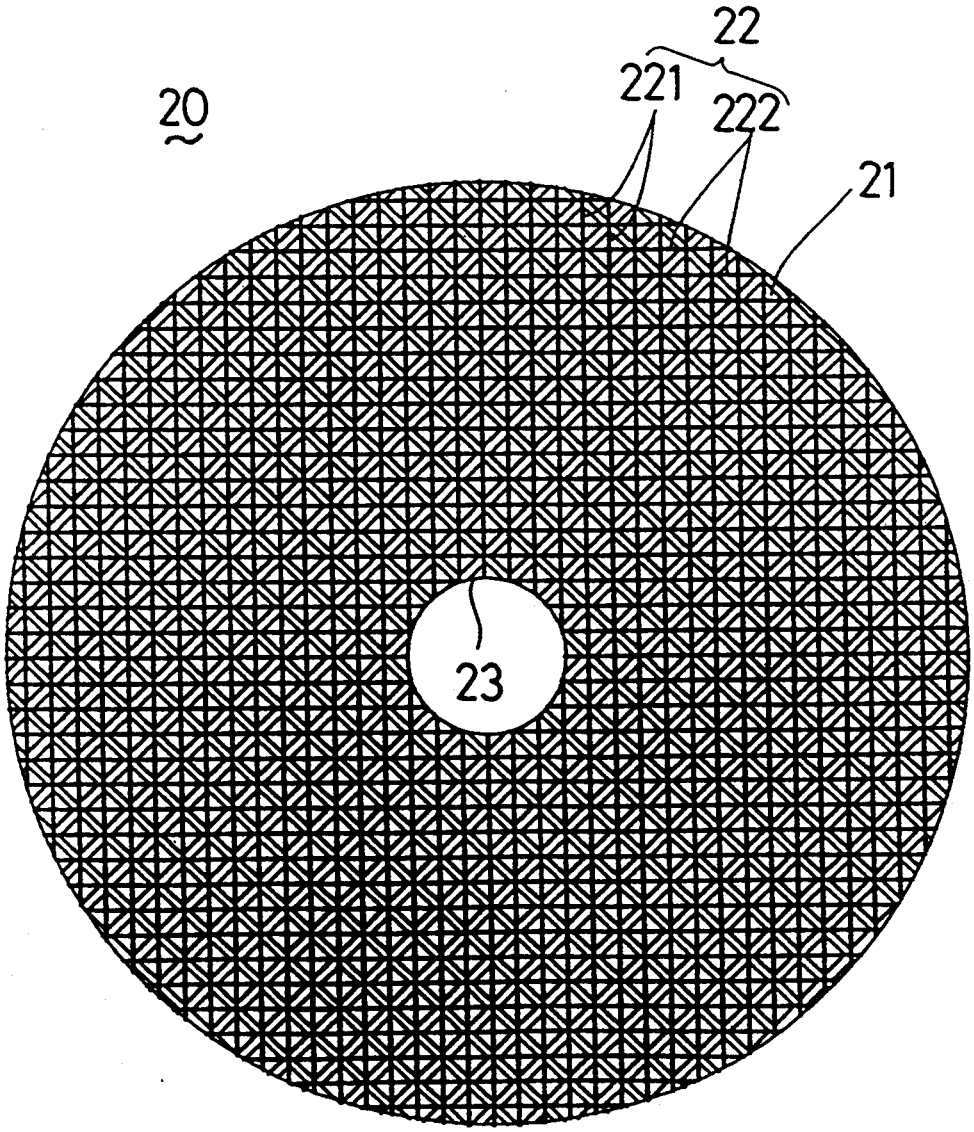
FIG. 14 is a bottom view of a vibration preventing base for the grinding wheel of FIG. 12.

As shown in FIG. 14, the vibration preventing base 20 includes a supporting body 21 formed of a supporting material made by mixing predetermined amounts of fine abrasive grains and binder made of thermoset resin such as denatured phenol resin or denatured epoxy resin; and a reinforcement 22 disposed on the surface of the supporting body 21 and provided with grooves 25 formed in the grid-like manner to have square waves. At the central portion of the supporting body 21, the bore 23 is formed for receiving the mandrel 24. As shown in FIG. 13, the thickness of the supporting body 21 is made gradually thinner in a direction from the inner offset section 212 to the outer flange section 211.

The reinforcement 22 for the vibration preventing base 20 has the same structure as that of Example 1 (see FIG. 4).

The abrasive body 300 is disposed on the reinforcement 22 for the vibration preventing base 20. Such an abrasive body 300 is formed of an abrasive made by mixing a predetermined amount of rough abrasive grains of melted alumina, silicon carbide, CBN, diamond, ceramic, or the like with a predetermined amount of binder made of thermoset resin such as denatured phenol resin or denatured epoxy resin. At the central portion of the abrasive body 300, the bore 34 is formed for receiving the mandrel 24. As shown in FIG. 13, the thickness of the abrasive body 300 is uniform at the inner offset section 212, but at the outer flange section 211, it is made gradually thicker in a direction from the inner offset section 212 to the outer flange section 211. Moreover, on the grinding surface of this abrasive body 300, a plurality of concentric circular grooves 35 and a plurality of radially extending grooves 36 are formed so as to divide the grinding surface into a plurality of blocks.

As the abrasive body reinforcing member 60 to be disposed on the grinding surface of the abrasive body 300, plain-woven fabric or twill-woven fabric made of glass fiber, carbonized fiber, or aramid fiber may be employed, similarly to the reinforcement 22 for the vibration preventing base 20.

Furthermore, the mandrel 24 is inserted into bores 23 and 34 which are formed at the central portions of the supporting body 21 and the abrasive body 300, respectively, so as to be attached to an output axis of a grinder or the like, and to hold the inner peripheral edge of the abrasive body reinforcing member 60.

With the above-mentioned configuration, the grinding wheel 12 of the present example can attain some advantages. That is, rough abrasive grains having grinding ability are used only for the abrasive body 300. On the other hand, even fine abrasive grains, which have not been utilized in prior art, can be used for the supporting body 21 for the vibration preventing base 20, thereby effectively utilizing all of the abrasive grains. Especially, in a case of melted alumina type of abrasive grains, the yield of an ingot can be improved. Moreover, the grooves 25, which are formed in the grid-like manner to have square waves on the reinforcement 22, make the elasticity of the reinforcement 22 almost uniform in all directions including a warp direction, a weft direction, and a diagonal direction connecting adjacent Junctions of the warp and weft of the reinforcement 22. As a result, vibration, which conventionally occurs during the grinding process, can be prevented, so that every part of the abrasive body 300 can almost evenly be brought in contact with an object to be ground. Thus, the abrasive body 300 can be prevented from being partially worn, thereby having longer durability. Furthermore, by dividing the grinding surface of the abrasive body 300 into a plurality of blocks defined by the concentric circular grooves 35 and radially extending grooves 36, it is possible to impart much more flexibility to the abrasive body 300. Therefore, the abrasive body 300 can be brought in contact with the object to be ground much more evenly compared with the cases of Examples 1 and 2.

Furthermore, according to the present example, the abrasive body 300 is covered with the abrasive body reinforcing member 60 so as to be integrated therewith, thereby preventing the occurrence of tensile stress at the interface between the inner offset section 212 and the outer flange section 211 due to excessive flexing of the abrasive body 300. Thus, the abrasive body 300 can be held firmly.

Figure 6:
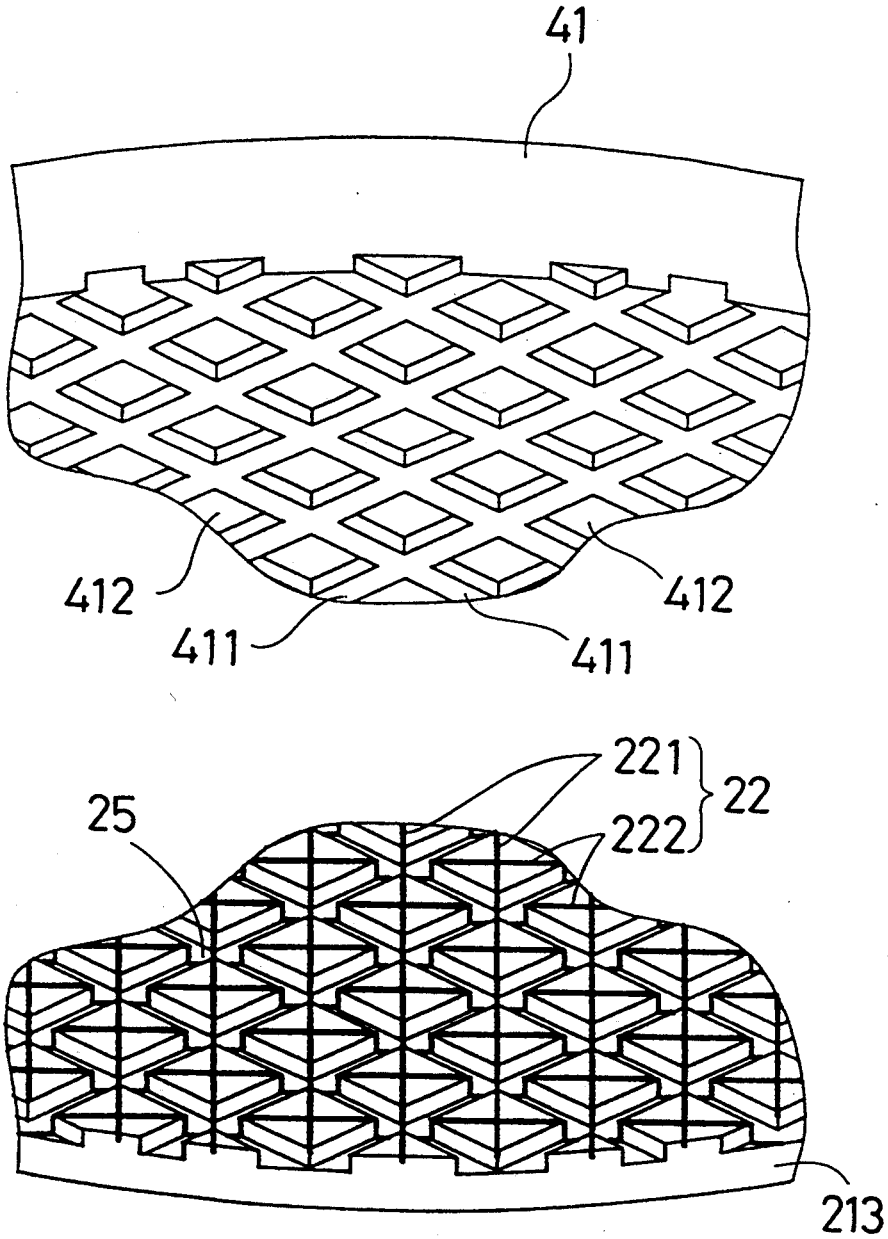
FIG. 6 perspectively shows part of the reinforcement and a supporting layer on which grooves are formed in a grid-like manner, and part of an upper mold having a grid-like concavo-convex pattern, during a step for molding the vibration preventing base of FIG. 3.
Figure 15:
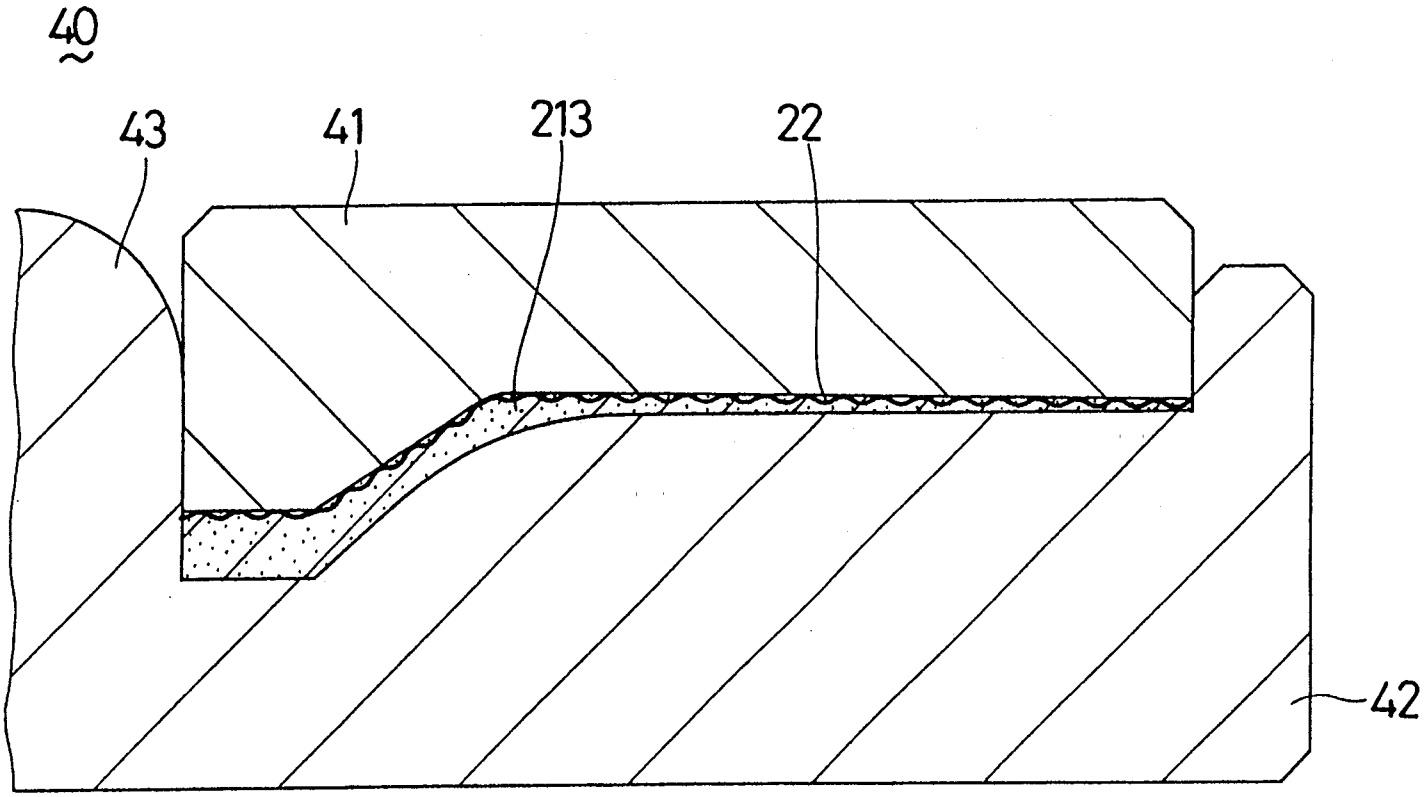
FIG. 15 is a half cross-sectional view of a molding apparatus for molding the vibration preventing base of FIG. 12.
Figure 16:
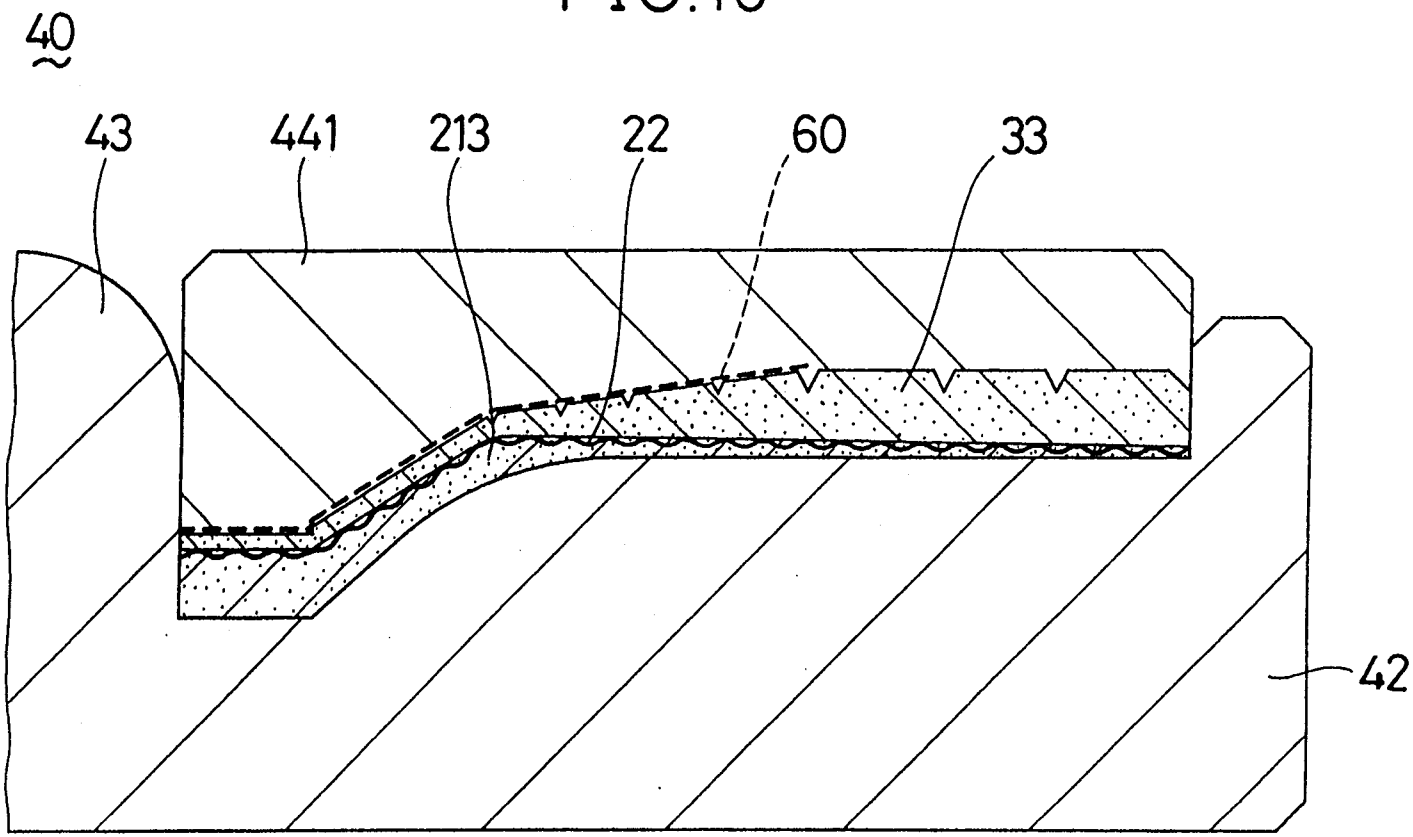
FIG. 16 is a half cross-sectional view of a molding apparatus for molding the grinding wheel of FIG. 12.

To manufacture the grinding wheel 12, a molding apparatus 40 such as shown in FIGS. 6, 15, and 16 may be employed. The molding apparatus 40 is constructed of a lower mold 42 having a surface corresponding to the back of the grinding wheel 12; an upper mold 41 having a concavo-convex pattern on the molding surface thereof: and a pressing mold 441 having a concavo-convex pattern on the molding surface thereof. The concavo-convex pattern of the upper mold 41 is constituted of convex portions 411 and concavo portions 412 corresponding to the grooves 25 formed in the grid-like manner on the surface of the vibration preventing base 20. The concavo-convex pattern of the pressing mold 441 is constituted of convex portions corresponding to the concentric circular grooves 35 and convex portions corresponding to the radially extending grooves 36. The lower mold 42 includes an upward protruding stem having a diameter adapted to the inner diameter of the mandrel 24.

Next, a method for manufacturing the grinding wheel 12 using such a molding apparatus 40 will be described. First, a prescribed amount of a supporting material, which is made by mixing abrasive grains and thermoset resin such as denatured phenol resin, is placed in the lower mold 42, and is homogenized using a homogenizer (not shown), thereby forming a supporting layer 21B so that the thickness thereof is gradually made thinner in a direction from the inner offset section 212 to the outer flange section 211. Then, the reinforcement 22 including thermoset resin such as denatured phenol resin is disposed on the supporting layer 213. Thereafter, the supporting layer 213 and the reinforcement 22 are heated, and then are pressed using the upper mold 41 so as to form the grooves 25 in the grid-like manner. At this time, the warp 221 and the weft 222 of the fabric used as the reinforcement 22 are arranged so as to be inclined at an angle of 45° relative to the concavo-convex pattern of the upper mold 41.

Next, a prescribed amount of an abrasive, which is made by mixing rough abrasive grains and thermoset resin such as denatured phenol resin, is placed in the lower mold 42, and is homogenized using a homogenizer (not shown) so that the thickness thereof is made uniform at the inner offset section 212, but at the outer flange section, it is gradually made thicker in a direction from the inner offset section 212 to the outer flange section 211, thereby forming an abrasive layer 33. Then, the abrasive layer 33 is heated, and is pressed using a pressing mold 441 having the molding surface corresponding to the grinding surface of the grinding wheel 12 so as to form the concentric circular grooves 35 and the radially extending grooves 36 on the abrasive layer 33. As a result, the abrasive layer 33 is integrated with the supporting layer 213. Thereafter, the abrasive body reinforcing member 60 is disposed on the abrasive layer 33. Under such a condition, the abrasive layer 33 and the abrasive body reinforcing member 60 are heated and are pressed using the pressing mold 41 again so as to be integrated with each other. Not being illustrated in Figures, under a condition where the mandrel 24 is accepted by the bores 23 and 34, the thus resulting semi-manufactured item is pressed. Then, the semi-manufactured item is taken out from the molding apparatus 40, and is sintered, thereby obtaining the grinding wheel 12. As is apparent from the above, the grinding wheel 12 of the present example can simply be manufactured on an assembly line.

Various other modifications will be apparent to and can be readily made by those skilled in the art without departing from the scope and spirit of the present invention. The scope of the present invention is therefore to be limited only by the claims appended hereto.

What is claimed is:

1. A grinding wheel including an inner offset section and an outer flange section, comprising:

a vibration preventing base having a supporting body and a reinforcement disposed thereon, said supporting body being formed of a supporting material made by mixing rough abrasive grains and binder, said reinforcement being provided with grooves formed in a grid-like manner to have square waves;

an abrasive body disposed on said reinforcement for the vibration preventing base, said abrasive body being formed of an abrasive made by mixing rough abrasive grains and binder; and a mandrel to be received by bores formed at central portions of said vibration preventing base and said abrasive body.

2. A grinding wheel according to claim 1, wherein fabric including warp and weft is employed as said reinforcement; and said grooves for said reinforcement are formed in diagonal directions connecting adjacent Junctions of said warp and weft by sinking every other Junction of said warp and weft.

3. A grinding wheel according to claim 2, wherein said fabric is plain-woven fabric made of glass fiber.

4. A grinding wheel according to claim 2, wherein said fabric is plain-woven fabric made of carbonized fiber.

5. A grinding wheel according to claim 2, wherein said fabric is plain-woven fabric made of aramid fiber.

6. A grinding wheel according to claim 2, wherein said fabric is twill-woven fabric made of glass fiber.

7. A grinding wheel according to claim 2, wherein said fabric is twill-woven fabric made of carbonized fiber.

8. A grinding wheel according to claim 2, wherein said fabric is twill-woven fabric made of aramid fiber.

9. A grinding wheel according to claim 1, wherein said abrasive body is formed by alternately bonding grinding pieces and chipping remover pieces on a peripheral portion of said reinforcement for said vibration preventing base so as to have a ring-like shape, said grinding pieces being formed of an abrasive made by mixing abrasive grains and binder at a high density, said chipping remover pieces being formed of a porous material made by mixing rough abrasive grains and binder at a low density.

10. A grinding wheel according to claim 2, wherein said abrasive body is formed by alternately bonding grinding pieces and chipping remover pieces on a peripheral portion of said reinforcement for said vibration preventing base so as to have a ring-like shape, said grinding pieces being formed of an abrasive made by mixing abrasive grains and binder at a high density, said chipping remover pieces being formed of a porous material made by mixing rough abrasive grains and binder at a low density.

11. A grinding wheel according to claim 1, wherein said abrasive body is formed of an abrasive made by mixing rough abrasive grains and binder so as to have a ring-like shape, and is disposed on a peripheral portion of said reinforcement for said vibration preventing base.

12. A grinding wheel according to claim 2, wherein said abrasive body is formed of an abrasive made by mixing rough abrasive grains and binder so as to have a ring-like shape, and is disposed on a peripheral portion of said reinforcement for said vibration preventing base.

13. A grinding wheel according to claim 1, wherein the thickness of said supporting body for said vibration preventing base is made gradually thinner in a direction from said inner offset section to said outer flange section, while the thickness of said abrasive body is made gradually thicker in the same direction.

14. A grinding wheel according to claim 2, wherein the thickness of said supporting body for said vibration preventing base is made gradually thinner in a direction from said inner offset section to said outer flange section, while the thickness of said abrasive body is made gradually thicker in the same direction.

15. A grinding wheel according to claim 13, wherein, an abrasive body reinforcing member is arranged on the grinding surface of said abrasive body, and said mandrel is received by said bores so as to hold an inner peripheral edge of said abrasive body reinforcing member.

16. A grinding wheel according to claim 14, wherein, an abrasive body reinforcing member is arranged on the grinding surface of said abrasive body, and said mandrel is received by said bores so as to hold an inner peripheral edge of said abrasive body reinforcing member.

17. A grinding wheel according to claim 13, wherein a plurality of concentric circular grooves and a plurality of radially extending grooves are formed on the grinding surface of said abrasive body.

18. A grinding wheel according to claim 14, wherein a plurality of concentric circular grooves and a plurality of radially extending grooves are formed on the grinding surface of said abrasive body.

19. A grinding wheel according to claim 15, wherein a plurality of concentric circular grooves and a plurality of radially extending grooves are formed on the grinding surface of said abrasive body.

20. A grinding wheel according to claim 16, wherein a plurality of concentric circular grooves and a plurality of radially extending grooves are formed on the grinding surface of said abrasive body.

* * * * *